United States Patent [19]

Cochran

[11] 4,239,496

[45] Dec. 16, 1980

[54] GAS CYCLE FLUID ENERGY PROCESS FOR FORMING COAL-IN-OIL MIXTURES

[75] Inventor: Joseph W. Cochran, Clearwater, Fla.

[73] Assignee: ComCo, Pittsburgh, Pa.

[21] Appl. No.: 966,780

[22] Filed: Dec. 6, 1978

[51] Int. Cl.[3] ..... C10L 1/32

[52] U.S. Cl. ..... 44/51; 241/5; 241/18

[58] Field of Search ..... 44/51; 241/1, 5, 18, 241/19

[56] References Cited

U.S. PATENT DOCUMENTS

| | | | |
|---|---|---|---|
| 1,532,647 | 4/1925 | Bergman | 241/5 |
| 1,542,346 | 6/1925 | Hoover et al. | 241/18 |
| 2,131,308 | 9/1938 | Blumner | 44/51 |
| 3,854,666 | 12/1974 | Switzer, Jr. | 241/18 |
| 3,897,010 | 7/1975 | Weishaupt et al. | 241/5 |
| 4,065,060 | 12/1977 | Booz | 241/16 |

*Primary Examiner*—Jacqueline V. Howard

*Attorney, Agent, or Firm*—Parmelee, Miller, Welsh & Kratz

[57] ABSTRACT

Process for forming coal-in-oil fuel mixtures where coal is pulverized in a fluid energy pulverizer by use of a noncombustible carrier gas, with the pulverized coal separated and the spent gas cleaned to remove moisture and residual coal, the cleaned gas compressed, reheated and returned to the pulverizer for re-use as carrier gas therein.

6 Claims, 1 Drawing Figure

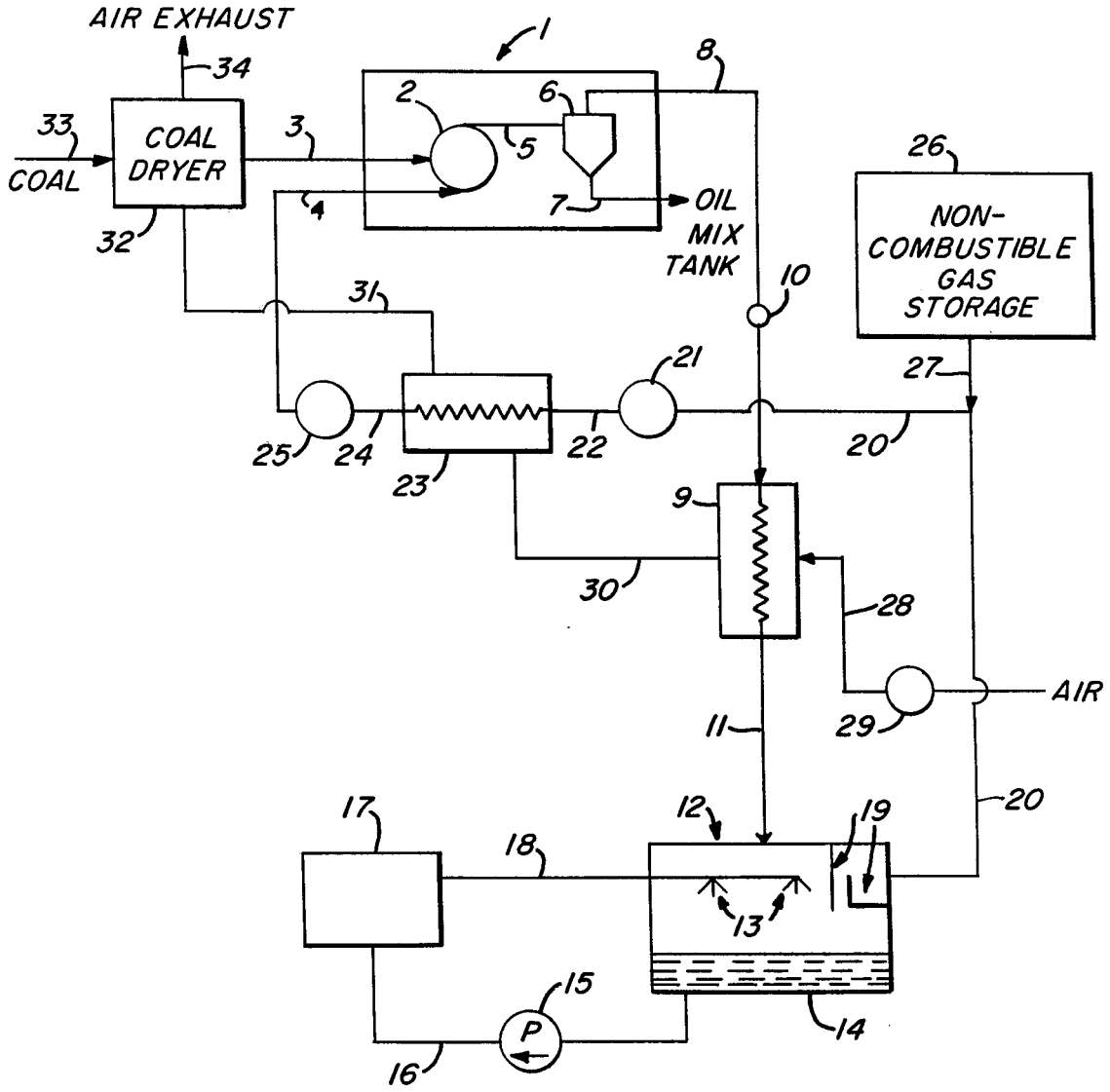
AIR EXHAUST
34
33
COAL
COAL DRYER
32
3
4
1
2
5
6
7
8
OIL MIX TANK
10
26
NON-COMBUSTIBLE GAS STORAGE
27
31
21
25
24
22
23
20
9
30
28
29
AIR
11
12
19
20
17
18
13
15
P
16
14

GAS CYCLE FLUID ENERGY PROCESS FOR FORMING COAL-IN-OIL MIXTURES

BACKGROUND OF THE INVENTION

Fluid energy mills or jet mills are well known and widely used for the pulverizing of solid materials. Such mills use the principal of high speed collision and refraction of solid particles charged to the mill along with a pressurized fluid medium. Generally, a high-pressure fluid, such as steam, air or other fluid, is injected through nozzles into an oval shaped device, with the fluid expanding after passage through nozzles. The solid particles are entrained in the fluid stream and swept about the interior of the device such that they collide with each other and are pulverized. The pulverized particles are then classified with finer particles discharged from the device for use, along with spent fluid, while coarser material is recycled for further pulverizing.

It has been proposed to use such fluid energy mills for grinding of coal to a fine particle size, whereby the pulverized coal may then be mixed with oil to form a coal-oil mixture for use as a fuel. Such coal-oil mixtures are especially useful in power plants which are designed for oil combustion but which, faced with the diminishing supply and increased cost of oil, must seak other fuel sources. Coal is charged, in such systems, to a fluid energy mill along with high pressure steam, with the discharge from the mill fed to cyclones or other solids removal means, wherein the pulverized coal is collected and then admixed with oil to make the desired coal-oil mixture. The steam is then discharged to the atmosphere.

The present invention is directed towards a system for utilizing such fluid energy mills in the pulverizing of coal to form fine particles of coal to be admixed with oil in forming a fuel and means for effecting such pulverizing under conditions of safety and energy conservation.

BRIEF SUMMARY OF THE INVENTION

A process for the formation of coal-oil mixtures wherein coal is pulverized in a fluid energy pulverizer by use of a noncombustible pressurized and heated carrier gas, with pulverized coal separated from the noncombustible gas for admixture with oil. The noncombustible gas is cleaned to remove moisture and residual coal particles therefrom, the cleaned gas compressed, heated and returned to the coal pulverizer for reuse as the carrier gas for further coal. The coal to be charged to the pulverizer may be dried and preheated by heat exchange with air that is heated by heat exchange with the noncombustible gaseous stream upon compression of the stream to the required pressure for injection into the fluid energy pulverizer.

BRIEF DESCRIPTION OF THE DRAWING

The drawing is a schematic illustration of the process of the present invention.

DETAILED DESCRIPTION

As schematically illustrated in FIG. 1, a fluid energy pulverizing system 1 is provided for grinding or pulverizing coal to a fine particle size for use in forming coal-oil mixtures. Charged to a fluid energy pulverizer 2 are coal from line 3 and a heated and pressurized gaseous stream from line 4. The heated and pressurized gaseous stream is a carrier gas that provides the driving force for the pulverizing of the coal particles, as is known in such devices, while precluding combustion or danger of explosion in the unit. A mixture of pulverized coal particles in carrier gas is exhausted from the pulverizer 2 through line 5, at a slight positive pressure of up to about 20 psia and a temperature of about 105°–180° C., and is passed to a cyclone or other gas-solids separation means 6 wherein the coal particles are separated from the exhausted carrier gas and are discharged through line 7 for admixture with oil in an oil mix tank (not shown) in a conventional manner to produce a coal-oil mixture for use as a fuel.

The carrier gas which is exhausted from the gas-solids separator means 6 through line 8 will carry some residual fine coal particles and moisture therewith. The hot gaseous stream, at a temperature in the range of about 105°–180° C. and at a slight positive pressure of up to about 20 psia, is passed through line 8 to a regenerative heat exchanger 9. Preferably, an oxygen probe 10 is present in the line 8. The hot gases, carrying residual coal particles and moisture, are passed through the heat exchanger 9 and then through line 11 to a gas washer 12.

Gas washer 12 comprises a gas washing unit which will remove moisture as well as residual coal particles from the carrier gas, and is illustrated as a wet gas washing system having a chamber where sprays of cooling fluid, such as water, are directed through sprayers 13 to collect the moisture and coal particles in a liquid bath 14 from which the coal particles can be subsequently separated. Fluid from the bath 14, after separation of solids therefrom, may be recycled, by means of a pump 15 through line 16, and then through a cooling tower or other cooling means 17 and then through line 18 back to the sprayers 13 for reuse. Preferably, the gas washer 12 contains a series of baffles or other liquid separation means 19 to remove liquid droplets from the carrier gas prior to discharge of the cleaned gas through line 20.

The cleaned gas is directed through line 20 to a first compressor 21 to pressurize and heat the cleaned gas, then through line 22 to a heat exchanger 23 where the hot gases are cooled, through line 24 to a second compressor 25 and thence through line 4 for return to the coal pulverizer for reuse.

Noncombustible gas for use in the present system is provided from a noncombustible gas storage unit 26, from which such gas is supplied to initiate the process and also from which make-up gas is provided, through line 27 to the line 20 leading to the compressors.

In providing for heat recovery from the system, air or other fluid is fed through line 28, such as by means of a fan 29, through the heat exchanger 9 where it is heated slightly and then through line 30 to the heat exchanger 23 where the air is further heated by hot carrier gas. The hot air is discharged from heat exchanger 23 through line 31 and is fed to a coal drying unit 32. In the coal drying unit 32, coal which is to be pulverized is charged through line 33 and then heated by the hot air, dried and discharged to line 3 where it is then fed to the coal pulverizer, while exhaust air from the coal drier is discharged to the atmosphere or otherwise directed through line 34.

Referring now in more detail to the process, the process requires the use of a noncombustible gas as the carrier for the coal in the coal pulverizer and in the exhausting of the crushed coal particles from the pulverizer and to a solids separator. In such pulverizers, the temperatures are on the order of 120°-370° C. and the gas charged thereto should be under a pressure of about 150-250 psia. The carrier gas stream, from line 4 into the coal pulverizer, should then be at such conditions.

The noncombustible gas may be any gas that can be so heated and pressurized, such as nitrogen, argon, helium, carbon dioxide or the like, with nitrogen being the preferred gas due to its relatively economical supply and good thermal properties.

After separation of the pulverized coal particles from the noncombustible gaseous stream, the gas should be at a temperature of between about 105°-180° C. and preferably maintained at a temperature above 105° C. through the heat exchanger 9 so that condensation does not occur therein, which could cause corrosion and deposit buildup.

The noncombustible gaseous stream, upon discharge from the gas washer, will be at a temperature of about 50° C. After compression in first compressor 21, the noncombustible gas will be pressurized to a pressure of about 55 psia and at a temperature on the order of 190° C. Heat exchange in heat exchanger 23 is then effected, with the noncombustible gas cooled therein to about 115° C. prior to passing to the second compressor 25. Upon discharge from the second compressor, the noncombustible gas is at the temperature and pressure required for use in the coal pulverizer, with a pressure of about 200 psia and a temperature of about 200° C. being preferred.

I claim:

1. In a process for forming coal-oil mixtures for combustion comprising the steps of:

(a) pulverizing moisture-containing coal in a fluid energy pulverizer by use at a substantially dry noncombustible gas stream, introduced thereto at an elevated temperature and pressure;

(b) evacuating the pulverized coal from said pulverizer in the noncombustible gas stream, (c) then separating the pulverized coal from the noncombustible gas stream; and (d) then mixing the pulverized coal with oil, wherein the improvement comprises the additional steps of:

(e) heating a stream of air by bringing said stream into heat exchange relation with the noncombustible gas stream after the pulverized coal has been removed from said gas stream; and then (f) drying the moisture containing coal with said heated stream of air before said coal is pulverized.

2. The process defined in claim 1 wherein between said heating and drying steps there are added the steps of:

(g) removing residual coal particles and moisture from the noncombustible gas stream;

(h) compressing said cleaned noncombustible gas stream; and (i) returning said cleaned noncombustible gas stream to the fluid energy pulverizer.

3. The process defined in claim 2 wherein before the cleaned noncombustible gas stream is returned to the fluid energy pulverizer, there is added the step of:

bringing the cleaned noncombustible gas stream into heat exchange relation with the stream of air heated in step (e) so as to further heat said stream of air and to cool said cleaned noncombustible gas stream.

4. The process defined in claim 3 including the additional step of compressing said cleaned noncombustible gas before returning it to the fluid energy pulverizer.

5. The process defined in claim 1 or 2 wherein the noncombustible gas is selected from the group comprising nitrogen, argon, helium and carbon dioxide.

6. The process of claim 5 wherein the noncombustible gas comprises nitrogen.

* * * * *